US005115923A

United States Patent [19]

Koizumi

[11] Patent Number: 5,115,923

[45] Date of Patent: May 26, 1992

[54] METHOD FOR STRETCHING AND FOLDING A JIB FOR CRANE

[75] Inventor: Yukio Koizumi, Akashi, Japan

[73] Assignee: Kabushiki Kaisha Kobe Seiko Sho, Kobe, Japan

[21] Appl. No.: 666,637

[22] Filed: Mar. 8, 1991

[30] Foreign Application Priority Data

May 30, 1990 [JP] Japan ..... 2-142941

[51] Int. Cl.[5] ..... B66C 23/66

[52] U.S. Cl. ..... 212/168; 212/187; 212/188; 212/266

[58] Field of Search ..... 212/182, 188, 237, 244, 212/260, 264, 265, 187, 199, 200, 204, 211, 224, 230-231, 233, 266-268, 168, 187, 269; 52/115-118, 636

[56] References Cited

U.S. PATENT DOCUMENTS

| | | | |
|---|---|---|---|
| 3,125,227 | 3/1964 | Kauffman et al. | 212/266 |
| 3,300,061 | 1/1967 | Bamford | 212/267 |
| 3,987,594 | 10/1976 | Rao et al. | 212/267 |
| 4,045,923 | 9/1977 | Shanmugasundaram | 52/118 |
| 4,260,064 | 4/1981 | Ekstam | 212/268 |
| 4,658,972 | 4/1987 | Koizumi et al. | 212/264 |
| 4,953,724 | 9/1990 | Koizumi | 212/266 |

FOREIGN PATENT DOCUMENTS

| | | |
|---|---|---|
| 084981 | 8/1983 | European Pat. Off. . |
| 55-135094 | 10/1980 | Japan . |
| 62-147687 | 9/1987 | Japan . |

*Primary Examiner*—Sherman D. Basinger

*Assistant Examiner*—Thomas J. Brahan

*Attorney, Agent, or Firm*—Oblon, Spivak, McClelland, Maier & Neustadt

[57] ABSTRACT

A device for stretching and folding a strut type jib for a crane, including a jib supporting mechanism for supporting the jib along one side surface of a boom under a vertically disposed condition of the jib where a forward end portion of the jib is directed to a forward end portion of the boom, and opposite flat planes of the jib are oriented horizontally in such a manner that the jib is slidable along the side surface of the boom in a range between a folded position of the jib where a base end portion of the jib is disposed aside a base end portion of the boom and an advance position of the jib where the base end portion of the jib is disposed aside the forward end portion of the boom; a pair of jib supporting shafts projecting outwardly from opposite side surfaces of the forward end portion of the boom; a pair of connecting portions provided at the base end portion of the jib and adapted to be connected to the jib supporting shafts upon stretching of the jib; and an engaging member provided at a lower end portion of the base end portion of the jib under the vertically disposed condition of the jib in such a manner that the jib is rotatable about a longitudinal axis of the jib. The engaging member is brought into engagement with one of the jib supporting shafts projecting from one of the opposite side surface of the forward end portion of the boom on the same side as the one side surface of the boom, at the advance position of the jib.

3 Claims, 6 Drawing Sheets

METHOD FOR STRETCHING AND FOLDING A JIB FOR CRANE

BACKGROUND OF THE INVENTION

The present invention relates to a method and device for stretching and folding a strut type jib for a wheel type crane such as a truck crane and a rough terrain crane, wherein the jib is stretched from a forward end of a boom in an operative condition of the jib, while the jib is being folded along the boom in an inoperative condition of the jib.

Conventionally, the following jib stretching and folding systems are known.

(1) In a jib twisting system as disclosed in Japanese Patent Publication No. 63-3827, a strut type jib (a jib consisting of right and left beams and a plurality of connecting bars connecting the right and left beams and having a flat tapering ladder-like structure) is folded along one side surface of a boom under a vertically disposed condition of the jib where opposite flat planes of the jib are oriented horizontally, and a base end portion of the jib is directed to a forward end portion of the boom. In an operative condition of the jib, a lower end portion of the base end portion of the jib is connected to the forward end portion of the boom, and the jib is suspended from this connection point as a pivotal point. Then, the jib is twisted at an angle of about 270 degrees, and is then swung up to be stretched forwardly from the forward end of the boom.

(2) In a jib swinging system as disclosed in Japanese Patent Publication No. 63-30278, a jib folded along one side surface of a boom under the vertically disposed condition of the jib is turned to be positioned under a lower surface of the boom. Under this condition, a base end portion of the jib is then connected to a forward end portion of the boom. Then, the jib is suspended from this connection point as a pivotal point. Thereafter, the jib is swung up to be stretched forwardly from the forward end of the boom.

(3) In a jib sliding system as disclosed in Japanese Patent Laid-open Publication No. 55-135094 and Japanese Utility Model Laid-open Publication No. 62-147687, a jib folded along a lower surface of a boom is slid forwardly, and a base end portion of the jib is connected to a forward end portion of the boom. Under this condition, the jib is stretched forwardly from the forward end of the boom.

However, all the above conventional systems have the following defects.

As both the jib twisting system mentioned in Paragraph (1) and the jib swinging system mentioned in Paragraph (2) include a jib suspending step, the jib must be swung up from the jib suspended condition. Accordingly, in the case that an obstacle such as an electric cable exists over the jib, the stretching and folding operation of the jib cannot be carried out.

In contrast, the jib sliding system mentioned in Paragraph (3) has an advantage such that the jib can be stretched and folded under the horizontal condition of the boom. However, since the jib is folded along the lower surface of the boom, the jib hinders a field of side view in the running of a crane, especially a rough terrain crane in which an operator cab is used commonly in both operating the crane and running the crane, and the boom extends to one side of the operator cab in running the crane.

SUMMARY OF THE INVENTION

It is accordingly an object of the present invention to provide a method and device for stretching and folding a jib for a crane which can eliminate the problem that the jib hinders the field of view in running the crane as utilizing, by use of the jib sliding system.

According to the present invention, there is provided a method and stretching and folding a strut type jib for a crane, comprising the steps of supporting said jib along one side surface of a boom in a vertically disposed condition of said jib where a forward end portion of said jib is directed to a forward end portion of said boom, such that said jib is slidable along the side surface of said boom in a range between a folded position of said jib where a base end portion of said jib is disposed adjacent a base end portion of said boom and an advance position of said jib where the base end portion of said jib is disposed adjacent the forward end portion of said boom; sliding said jib from said folded position to said advance position; connecting a lower end portion of the base end portion of said jib in the vertically disposed condition of said jib to the forward end portion of said boom in such a manner that said jib is rotatable about a longitudinal axis of said jib; and rotating said jib about the longitudinal axis of said jib at an angle of 90 degrees to support the base end portion of said jib at the forward end portion of said boom.

According to the present invention, there is also provided a device for stretching and folding a strut type jib for a crane, comprising (I) jib supporting means for supporting said jib along one side surface of a boom in a vertically disposed condition of said jib where a forward end portion of said jib is directed to a forward end portion of said boom, such that said jib is slidable along the side surface of said boom in a range between a folded position of said jib where a base end portion of said jib is disposed adjacent a base end portion of said boom and an advance position of said jib where the base end portion of said jib is disposed adjacent the forward end portion of said boom; (II) a pair of jib supporting shafts projecting outwardly from opposite side surfaces of the forward end portion of said boom; (III) a pair of connecting portions provided at the base end portion of said jib and adapted to be connected to said jib supporting shafts upon stretching of said jib; and (IV) an engaging member provided at a lower end portion of the base end portion of said jib in the vertically disposed condition of said jib in such a manner that said jib is rotatable on the engaging member about a longitudinal axis of said jib.

In the above jib stretching and folding device, said jib supporting means comprises a guide roller provided at an upper end portion of the base end portion of said jib under the vertically disposed condition of said jib, a guide rail provided on said boom for supporting and guiding said guide roller between the folded position and the advance position of said jib, and a jib supporting roller provided at the forward end portion of said boom for supporting said jib from an underside thereof so that said jib is slidable on said jib supporting roller in the range between the folded position and the advance position of said jib.

With the above-mentioned construction, the present invention basically utilizes the jib sliding system, and the present invention accordingly has the advantage of the jib sliding system such that the jib can be stretched and folded without swinging up the boom.

Furthermore, the jib can be displaced between the vertically disposed condition and the stretched condition (horizontally disposed condition) of the jib by rotating the jib about the longitudinal axis of the jib at an angle of 90 degrees. In other words, the jib can be folded along the side surface of the boom under the vertically disposed condition by combining a jib rotating step with the jib sliding system. Accordingly, there is no possibility that the jib hinders the field of view in running the crane.

Additionally, as the jib is supported on its upper and lower sides in the vertically disposed condition during the jib sliding operation by the jib supporting means, the jib can slide stably with the vertically disposed condition maintained.

Other objects and features of the invention will be more fully understood from the following detailed description and appended claims when taken with the accompanying drawings.

DETAILED DESCRIPTION OF THE PREFERRED EMBODIMENT

Figure 1:
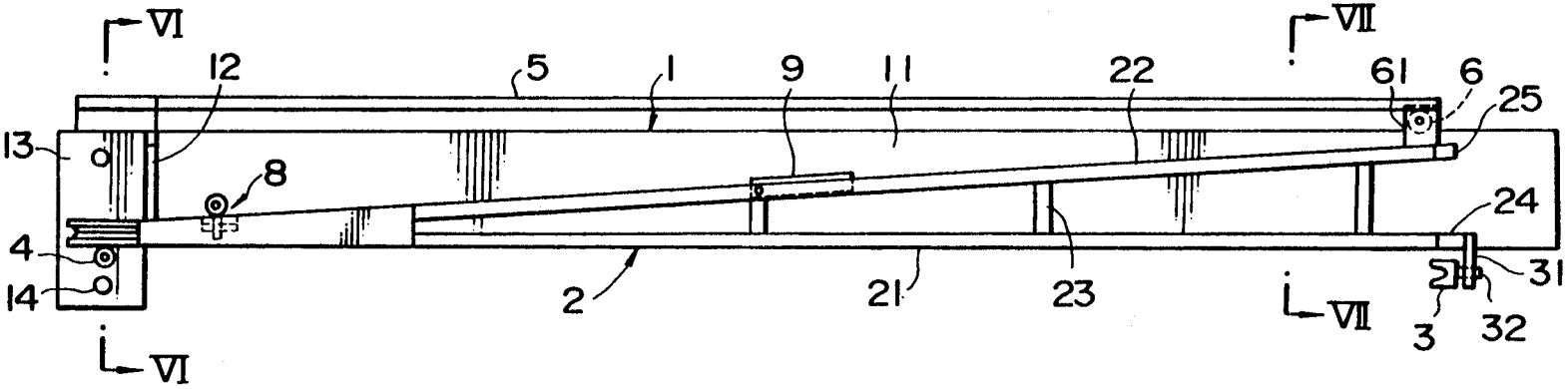
FIG. 1 is a schematic side view of the jib under the jib folded condition according to a preferred embodiment of the present invention.

There will now be described a preferred embodiment of the present invention with reference to the drawings.

Referring to the drawings, reference numeral 1 designates a telescopic boom, and reference numeral 2 designates a strut type jib.

The boom 1 is normally constructed of a base boom and plural stages of movable booms. However, for better understanding, the boom 1 shown is a two-stage boom consisting of a base boom 11 and a single-stage movable boom 12.

Figure 6:
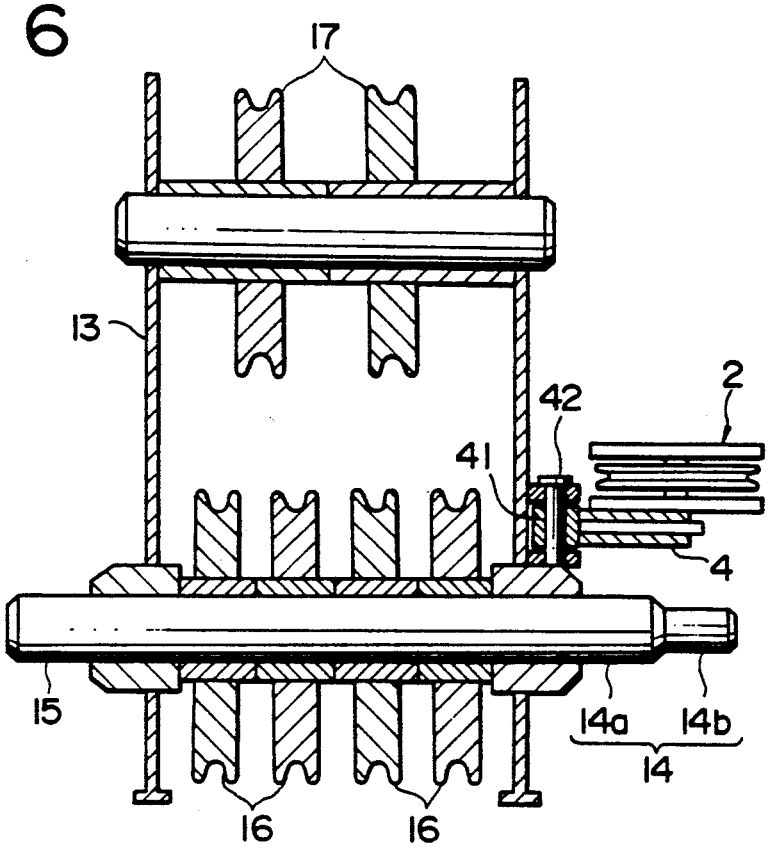
FIG. 6 is an enlarged cross section taken along the line VI—VI in FIG. 1.
Figure 9:
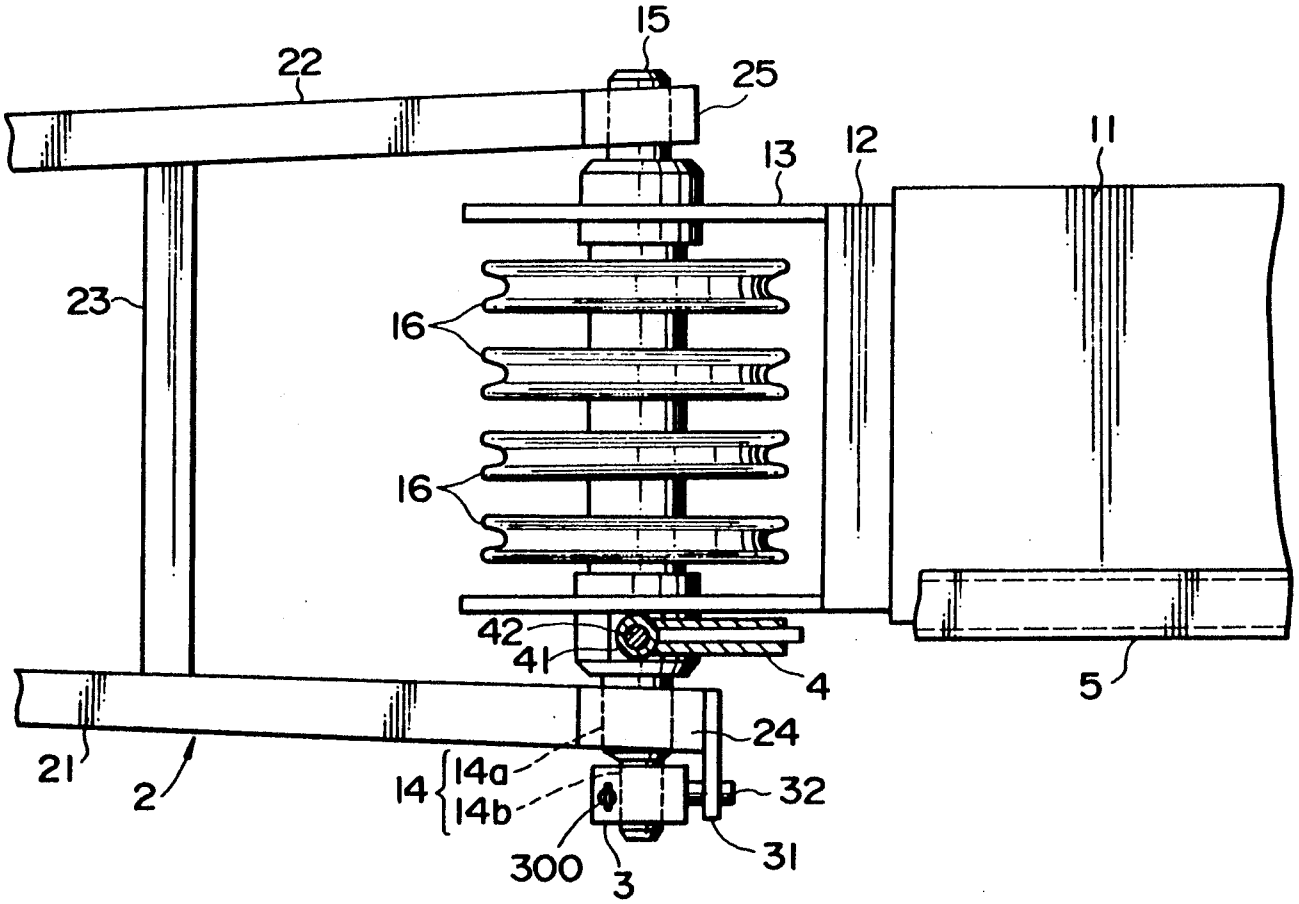
FIG. 9 is an enlarged plan view of a forward end portion of the boom, partially cut away, under the jib stretched condition.

A forward end portion (boom head) 13 of the movable boom 12 of the boom 1 is provided with left and right jib supporting shafts 14 and 15 projecting horizontally outwardly from left and right side surfaces of the boom head 13, respectively (see FIGS. 6 and 9).

The left jib supporting shaft 14 is constructed of a main shaft portion 14*a* having a length equal to that of the right jib supporting shaft 15 and an auxiliary shaft portion 14*b* integrally extending from the main shaft portion 14*a*. Referring to FIGS. 6 and 9, reference numerals 16 and 17 designate boom point main sheaves and idler sheaves provided in the boom head 13, respectively.

As well known, the jib 2 has a flat tapering ladder-like structure constructed of left and right beams 21 and 22 and a plurality of cross bars 23 connecting the left and right beams 21 and 22.

In an inoperative condition of the jib 2 as shown in FIG. 1, the jib 2 is folded along the left side surface of the boom 1 under the condition where a forward end portion of the jib 2 is disposed on the left side of the boom head 13, and the jib 2 is disposed in a vertical condition such that opposite flat planes of the jib 2 are oriented horizontally (i.e., the left and right beams 21 and 22 are disposed as lower and upper beams, respectively).

Figure 5:
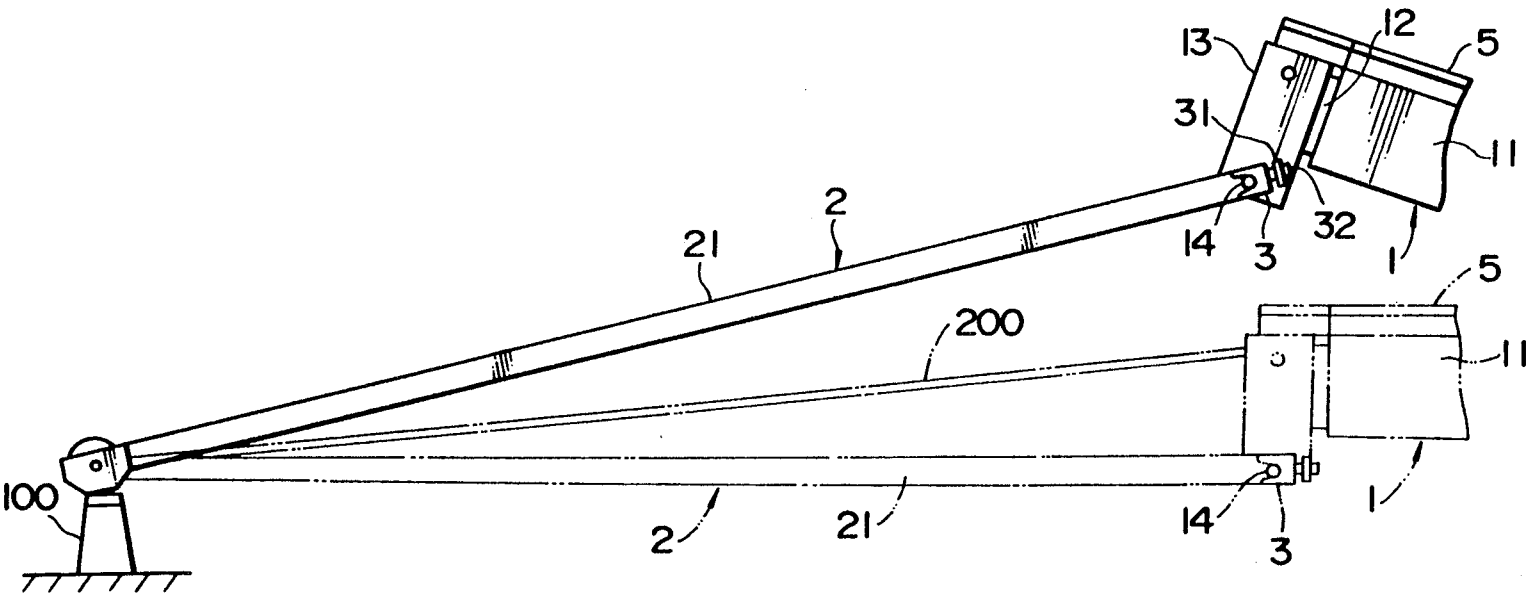
Figure 8:
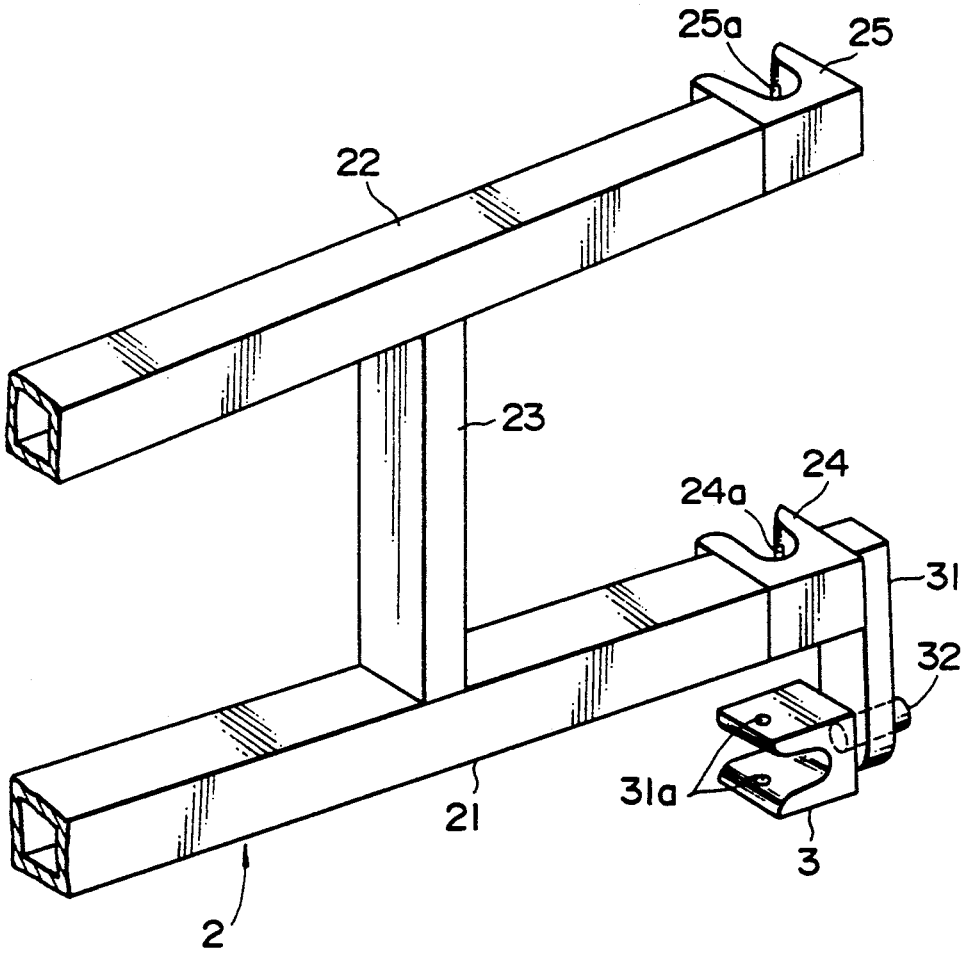
FIG. 8 is an enlarged perspective view of a base end portion of the jib.

The jib 2 is provided at its base end (i.e., base ends of the left and right beams 21 and 22) with a pair of forked jib feet 24 and 25, respectively (see FIG. 8). Under the jib folded condition, the forked jib feet 24 and 25 are oriented to the left side surface of the base boom 11 of the boom 1. Under an operative condition of the jib 2 as shown in FIGS. 5 and 9, the jib feet 24 and 25 are engaged and connected with the jib supporting shafts 14 and 15, respectively, in such a manner as to overhang the jib supporting shafts 14 and 15. Under this condition, the jib 2 is stretched forwardly from the forward end of the boom 1.

As shown in FIG. 8, the jib feet 24 and 25 are formed with pin insert holes 24*a* and 25*a*, respectively, through which pins (not shown) for preventing disengagement of the jib feet 24 and 25 from the jib supporting shafts 14 and 15 are inserted upon stretching of the jib 2.

The jib foot 24 disposed at the lower position under the jib folded condition (which jib foot 24 will be hereinafter referred to as a left jib foot on the basis of a jib stretched condition, and the other jib foot 25 will be hereinafter referred to as a right jib foot) is provided with an auxiliary forked jib foot 3 as the engaging member according to the present invention. The auxiliary forked jib foot 3 is oriented to the forward end of the jib 2.

The auxiliary jib foot 3 is rotatably supported via a plate 31 connected to the left jib foot 24 and a support shaft 32 connected to the plate 31 so as to extend along the left beam 21 of the jib 2. That is, the auxiliary jib foot 3 is adapted to be rotated about the support shaft 32 in an angular range between a position where the auxiliary jib foot 3 is disposed below the left jib foot 24 in the jib folded condition and a position where the auxiliary jib foot 3 is disposed on the left side of the left jib foot 24 in the jib stretched condition. Referring to FIG. 8, reference numerals 31*a* designate pin insert holes formed through the auxiliary jib foot 3.

The jib supporting means according to the present invention will now be described.

A jib supporting roller 4 is provided on the left side of the boom head 13 at a position above the left jib supporting shaft 14.

Figure 2:
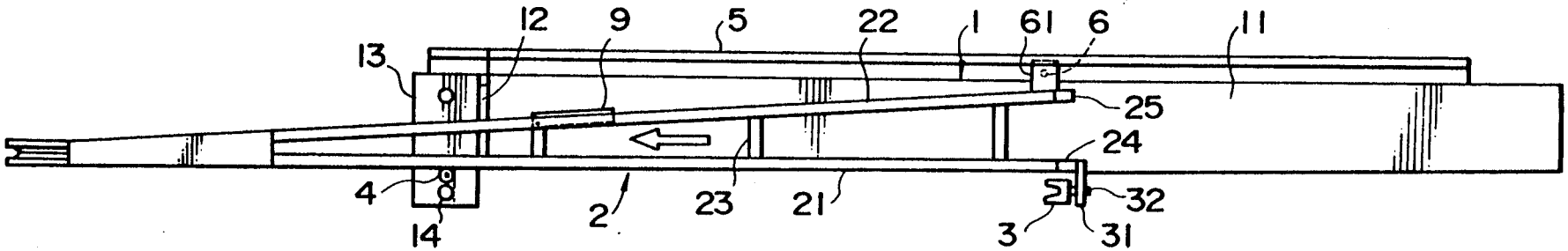
FIGS. 2 to 5 are schematic side view of the jib for explaining the procedure of stretching the jib.
Figure 3:
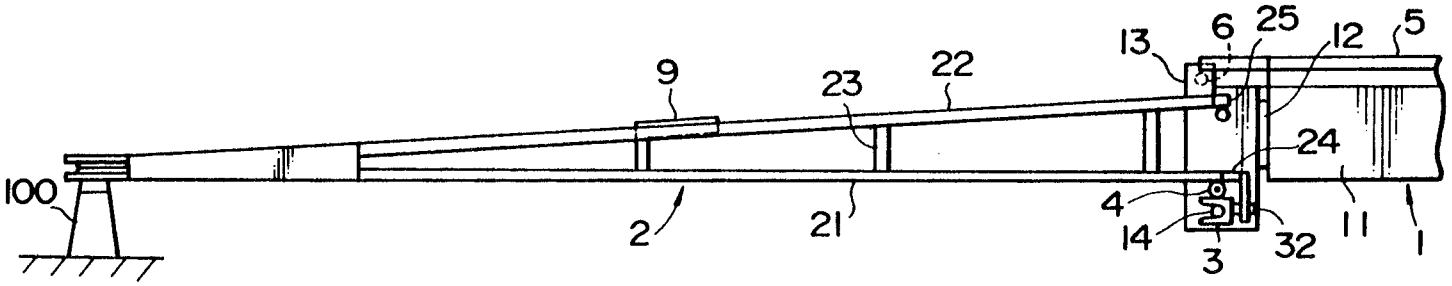

As shown in FIGS. 6 and 9, the jib supporting roller 4 is supported to a cylindrical boss 41 so as to be rotatable about a horizontal shaft 43 extending from the cylindrical boss 41. The boss 41 is mounted to the boom head 13 so as to be rotatable about a vertical shaft 42 which is disposed vertically when the boom is in the horizontal condition as shown in FIGS. 1 to 3. In a jib sliding step as shown in FIGS. 1 to 3 and 6, the jib supporting roller 4 projects perpendicularly from the left side surface of the boom head 13, so as to support the jib 2 from the underside thereof. In the other conditions, the jib supporting roller 4 is so folded as to extend along the boom head 13 as shown in FIG. 9 by rotating the boss 41 about the vertical shaft 42, so as not to hinder the stretching and folding operations of the jib 2.

Figure 4:
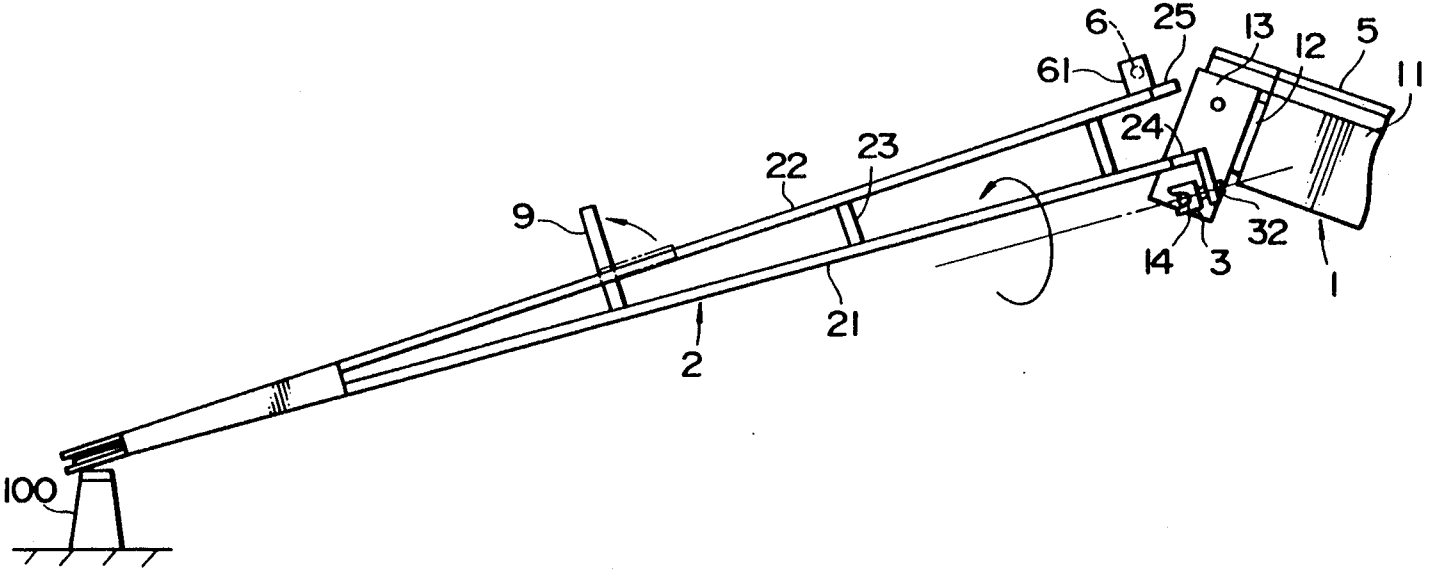

In FIGS. 4 and 5, the jib supporting roller 4 in the folded condition thereof is not shown. In the projected condition and the folded condition of the jib supporting roller 4, the jib supporting roller 4 is fixed in position by a pin (not shown) via a bracket (not shown) to the boom head 13.

Figure 7:
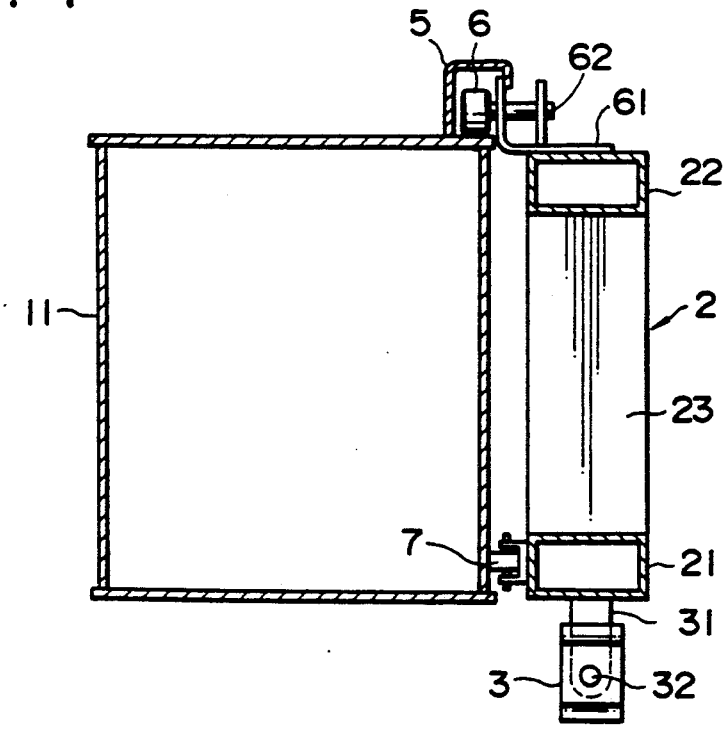
FIG. 7 is an enlarged cross section taken along the line VII—VII in FIG. 1.

The boom 1 is provided with a guide rail 5 extending over the substantially entire length of the boom from the base end portion of the base boom 11 to the boom head 13. As shown in FIG. 7, the guide rail 5 is mounted on an upper surface of the boom 1 at a left side portion thereof so as to open to the left.

On the other hand, the jib 2 is provided with a guide roller 6 at the base end portion of the right beam 22. As shown in FIG. 7, the guide roller 6 is mounted via a bracket 61 to the right beam 22 so as to be rotatable about a horizontal shaft 62 in such a manner that the guide roller 6 is adapted to roll on the upper surface of the boom 1 in the guide rail 5.

Furthermore, as shown in FIG. 7, the boom 1 is provided with an auxiliary guide roller 7 at the base end portion of the left beam 21. The auxiliary guide roller 7 is rotatably supported to the left beam 21 so as to roll on the left side surface of the boom 1.

Thus, in the jib folded condition, the forward end portion of the jib 2 is supported by the jib supporting roller 4, and the base end portion of the jib 2 is supported by the guide roller 6 in cooperation with the guide rail 5. Further, the jib 2 is maintained a given space from the left side surface of the boom 1 by the auxiliary guide roller 7 rollingly contacting with the left side surface of the boom 1.

Referring to FIG. 1, reference numeral 8 designates a jib fixing device for fixing the jib 2 to the boom 1 by means of a pin in the jib folded condition.

Referring to FIGS. 1 to 4, reference numeral 9 designates a jib rotating rod serving as a handle for rotating the jib 2 in a jib rotating step. The jib rotating rod 9 is mounted to a longitudinally middle portion of the right beam 22 of the jib 2 near a center of gravity of the jib 2 so as to be pivotable to project perpendicularly to the right beam 22 as shown in FIG. 4. In any steps other than the jib rotating step, the jib rotating rod 9 is so folded as to extend along the jib 2 as shown in FIGS. 1 to 3.

The jib 2 is stretched from the folded condition shown in FIG. 1 in accordance with the following steps.

(1) Jib Sliding Step

After the fixed condition of the jib 2 by the jib fixing device 8 is cancelled in the vertical condition of the jib 2, the jib 2 is slid forwardly (see FIG. 2).

During the sliding operation of the jib 2, the jib 2 is supported at its forward and base end portions by the boom 1. Furthermore, the forward end portion of the jib 2 is supported from its underside, and the base end portion of the jib 2 is supported from its upperside. Therefore, the jib 2 can be stably slid under the vertically disposed condition of the jib 2.

Furthermore, the jib 2 is supported at its forward and base end portions by the rollers (i.e., the jib supporting roller 4 and the guide roller 6), and the jib 2 is prevented from directly contacting the boom 1 by means of the auxiliary guide roller 7. Therefore, frictional resistance between the jib 2 and the boom 1 during the sliding operation can be minimized to thereby ensure smooth sliding of the jib 2.

When the jib 2 is slid from the folded position shown in FIG. 1 to reach an advance position where the base end portion of the jib 2 is positioned on the left side of the boom head 13 as shown in FIG. 3, the auxiliary jib foot 3 is automatically brought into engagement with the auxiliary shaft portion 14*b* of the left jib supporting shaft 14. At this time, the guide roller 6 is positioned at a forward end of the guide rail 5.

In the above advance position of the jib 2, the forward end portion of the jib 2 is supported by a stand 100 as shown in FIG. 3. Alternatively, the forward end portion of the jib 2 may be supported on the ground by swinging down the boom 1.

Further, a holder pin 300 (see FIG. 9) is inserted into the pin insert holes 31 of the auxiliary jib foot 3 shown in FIG. 8, so as to prevent disengagement of the auxiliary jib foot 3 from the jib supporting shaft 14.

Further, as the jib supporting roller 4 becomes unnecessary in the subsequent steps, it is folded along the left side surface of the boom 1 so as not to hinder the subsequent operation as shown in FIG. 9.

(2) Jib Rotating Step

As shown in FIG. 4, the boom 1 is swung up to thereby downwardly incline the jib 2 and forwardly separate the guide roller 6 and the right jib foot 25 from the guide rail 5 and the boom head 13, respectively.

Then, the jib rotating rod 9 is erected, and the whole of the jib 2 is rotated clockwise by 90 degrees about the support shaft 32 of the auxiliary jib foot 3 by handling the jib rotating rod 9.

As a result, the left jib foot 24 and the right jib foot 25 are brought into engagement with the main shaft portion 14*a* of the left jib supporting shaft 14 and the right jib supporting shaft 15, respectively, in such a manner as to overhang the support shafts 14 and 15 as shown in FIGS. 5 and 9.

Then, as shown by a phantom line in FIG. 5, the boom 1 is swung down to restore the original horizontal condition, and the left and right jib feet 24 and 25 are fixedly connected to the left and right jib supporting shafts 14 and 15 by inserting pins (not shown) into the pin insert holes 24*a* and 25*a* shown in FIG. 8. Further, as shown by a phantom line in FIG. 5, a suspension rod 200 for supporting the jib 2 is stretched between the jib 2 and the boom head 13.

In this manner, the stretching operation of the jib 2 is completed.

On the other hand, the folding operation of the jib 2 can be carried out in the procedure reverse to that in the stretching operation as mentioned above.

The sliding operation of the jib 2 in stretching or folding the jib 2 can be manually effected sufficiently easily owing to the roller operation as mentioned above. However, in the case that the jib 2 is large for use with a large crane, the jib 2 may be slid by utilizing a hoisting rope to be driven by a winch of the crane. In this case, in the jib stretching operation, the jib 2 is forwardly slid while being braked by the hoisting rope under the inclined condition of the boom 1 where the boom 1 is swung down, while in the jib folding operation, the jib 2 is drawn backwardly by the hoisting rope under the horizontal condition of the boom 1.

Further, a mechanism for limiting the rotational angle of the jib 2 to 90 degrees may be provided on the jib 2 (e.g., a portion for mounting the auxiliary jib foot 3), so as to prevent excess rotation of the jib 2 over 90 degrees between the vertically disposed condition of the jib 2 and the horizontally disposed condition upon stretching of the jib 2.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A method of stretching and folding a substantially flat strut type jib for a crane, comprising the steps of:

supporting said jib in a vertically disposed condition along one vertical side surface of a boom in a horizontally disposed condition wherein a forward end portion of said jib is directed to a forward end portion of said boom and a base end portion of said jib is oriented to have upper and lower portions lying one above the other;

sliding said jib along a vertical side surface of said boom from a folded position of said jib where a base end portion of said jib is disposed adjacent a base end portion of said boom to an advance position of said jib where the base end portion of said jib is disposed adjacent the forward end portion of said boom;

connecting the lower portion of the base end portion of said jib to the forward end portion of said boom in such a manner that said jib is rotatable about a longitudinal axis of said jib;

rotating said jib about the longitudinal axis of said jib by an angle of substantially 90 degrees from said vertically disposed condition; and connecting another end portion of the base end portion of said jib to the forward end portion of said boom.

2. The method of claim 1 including the step of folding the stretched jib back to said vertically disposed condition.

3. The method of claim 1 including the step of connecting a suspension rod between the rotated jib and the forward end portion of the boom.

* * * * *